US005516050A

United States Patent [19]

Yamamoto et al.

[11] Patent Number: 5,516,050

[45] Date of Patent: May 14, 1996

[54] INDUSTRIAL ROTARY SHREDDER

[75] Inventors: David K. Yamamoto, Paris; Peter Viveen, Cambridge, both of Canada

[73] Assignee: BASF Corporation, Mt. Olive, N.J.

[21] Appl. No.: 394,348

[22] Filed: Feb. 27, 1995

[51] Int. Cl.[6] ..... B02C 18/06; B02C 18/16

[52] U.S. Cl. ..... 241/167; 241/236

[58] Field of Search ..... 241/167, 236, 241/DIG. 38, 166

[56] References Cited

U.S. PATENT DOCUMENTS

| | | | |
|---|---|---|---|
| 3,146,960 | 9/1964 | DeGraff . | |
| 3,630,460 | 10/1969 | Goldhammer | 241/236 |
| 3,664,592 | 5/1972 | Schweigert et al. . | |
| 3,845,907 | 11/1974 | Schwarz | 241/36 |
| 4,034,918 | 7/1977 | Culbertson et al. | 241/36 |
| 4,627,581 | 12/1986 | Holiman et al. | 241/167 |
| 5,178,336 | 1/1993 | Lodovico et al. | 241/99 |
| 5,232,510 | 8/1993 | Tilbey | 241/167 X |
| 5,409,171 | 4/1995 | Stangenberg et al. | 241/167 |

FOREIGN PATENT DOCUMENTS

| | | | |
|---|---|---|---|
| 2059804 | 4/1981 | United Kingdom | 241/167 |

*Primary Examiner*—John Husar
*Attorney, Agent, or Firm*—Nixon & Vanderhye

[57] ABSTRACT

Rows of finger blocks are mounted to a frame body of a rotary industrial shredder laterally parallel to respective ones of the counter-rotational pair of shafts so as to be moveable slightly, but meaningfully, during the shredding operation while maintaining tight clearance relationships between the fingers and cutters. In such a manner, waste material, particularly waste fibrous material such as waste carpet, may be stripped satisfactorily from the cutter and spacer discs carried by the shafts. Preferably, the finger blocks include unitary cutter and spacer fingers extending inwardly towards the shafts in respective opposed relationship to cutter and spacer discs carried thereby.

8 Claims, 2 Drawing Sheets

INDUSTRIAL ROTARY SHREDDER

FIELD OF INVENTION

The present invention relates generally to the field of shredding apparatus, and more particularly, to industrial shredding apparatus having opposed interdigitated rotary disc-type cutter elements.

BACKGROUND AND SUMMARY OF THE INVENTION

Rotary shredders are well known apparatus which are used in a variety of situations so as to comminute waste material (e.g., tires, glass, masonry, wood and the like) for purposes of reducing the bulk of such waste material and/or to more easily facilitate recycling. In general, conventional rotary shredding apparatus are provided with a pair of parallel, horizontally spaced-apart, driven cutter shafts each of which mounts a series of alternating disc-type cutter and spacer elements equally spaced-apart along the shaft axes. The cutter discs on the shafts are interdigitated. That is, the cutter discs on one of the shafts are thus fixed at a position along the shaft axis so that they extend into the space between the cutters on the other shaft—i.e., into the spaces between the cutter discs established by the spacer discs.

The cutter shafts are counter-rotated so that the upper portions of the cutter discs on the two shafts rotate toward each other to force material fed into the apparatus from above downwardly between the two shafts where the material is shredded in the nip between the interdigitated cutter and spacer elements. (See, for example, U.S. Pat. No. 4,034,918, the entire content of which is incorporated expressly hereinto by reference.)

Conventional rotary shredders are typically provided with a plurality of immovable finger elements which extend inwardly toward the cutter/spacer discs. The purpose of such finger elements is to strip shredded material from the cutter and spacer discs to thereby prevent such shredded material from wrapping around the cutter shafts and overloading the shaft drives. However, practice has shown that for some fibrous waste material (e.g., waste carpet), immovably mounted finger elements do not serve their intended purpose.

In this regard, shredded waste fibrous material typically will overhang the tip of conventional cutter hooks. This overhanging material cannot be satisfactorily stripped from the cutters with traditional fingers and thus normally become jammed in between the fingers (known in art parlance as "bearding"). Severe bearding results in overload conditions in downstream processing equipment since material typically would build to a large mass within the shredder and then fall into the discharge chute. The mass of material can be so great as to sometimes jam or stall the conveying systems.

Traditional tight fitting fixed fingers of welded construction cannot be assembled to the necessary tight running clearances because of weld distortion and typical variations in the shredder body weldment. To maintain as tight a fit as possible, the shredder is typically used as an assembly jig. Once removed, these fingers are difficult or sometimes impossible to reassemble due to weld distortion and their custom fit within the shredder body.

It has now been discovered, however, that waste fibrous material may be satisfactorily stripped from the cutter and spacer discs if the finger elements are mounted to allow for slight, but meaning, movements relative to the cutter and spacer discs. That is, according to the present invention, the finger elements are not immovable, but instead are purposefully mounted relative to the cutter and spacer discs so that some movement is allowed during the shredding operation.

The moveable fingers according to the present invention thus permit shredder operation with tighter cutter-to-finger clearance than would be practical with conventional fixed-position (immovable) fibers. Side clearances may be held to tighter running fits because the finger can move and self-align. The finger section that is aligned with the knife hook is thus designed for tight clearance to the knife tip to "nip off" material that overhangs the knife hook. For materials such as fibers, it is especially desirable to make the knife and spacer discs an integral component to enable one to further reduce the knife tip-to-finger running clearance.

Preferably, according to the present invention, a series of individual finger blocks is mounted to the shredder frame to allow for selected ones of the individual finger blocks to be removed (e.g., for repair or replacement) without removal of the remaining finger blocks in the series. Each of the individual finger blocks preferably includes unitary cutter and spacer fingers extending generally radially towards the cutter and spacer discs, respectively. That is, the cutter and spacer finger discs extend generally radially toward a respective one of the cutter and spacer discs so as to strip shredded material therefrom.

The individual finger blocks of this invention provide improved serviceability. That is, (i) the finger blocks can be individually removed and replaced; (ii) the finger blocks can be premanufactured and assembled at the site with a controlled fit; (iii) only worn or damaged finger blocks need to be replaced; and (iv) individual finger blocks are light and easily handled.

Further aspects and advantages of this invention will become more clear after careful consideration is given to the following detailed description of the preferred exemplary embodiment thereof.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
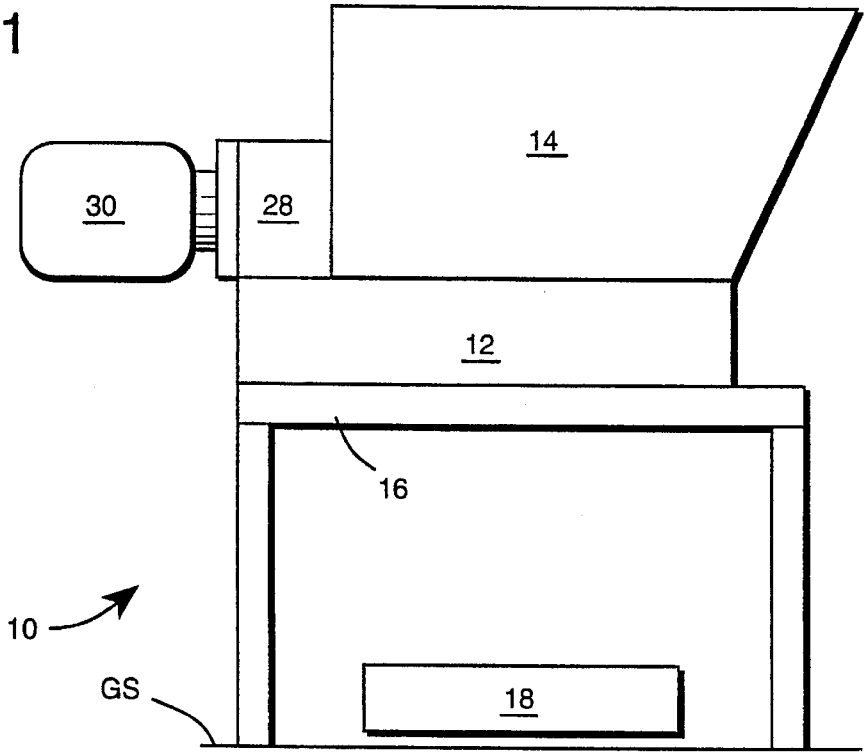
FIG. 1 is a side elevation view showing one preferred embodiment of the industrial shredder according to the present invention.
Figure 2:
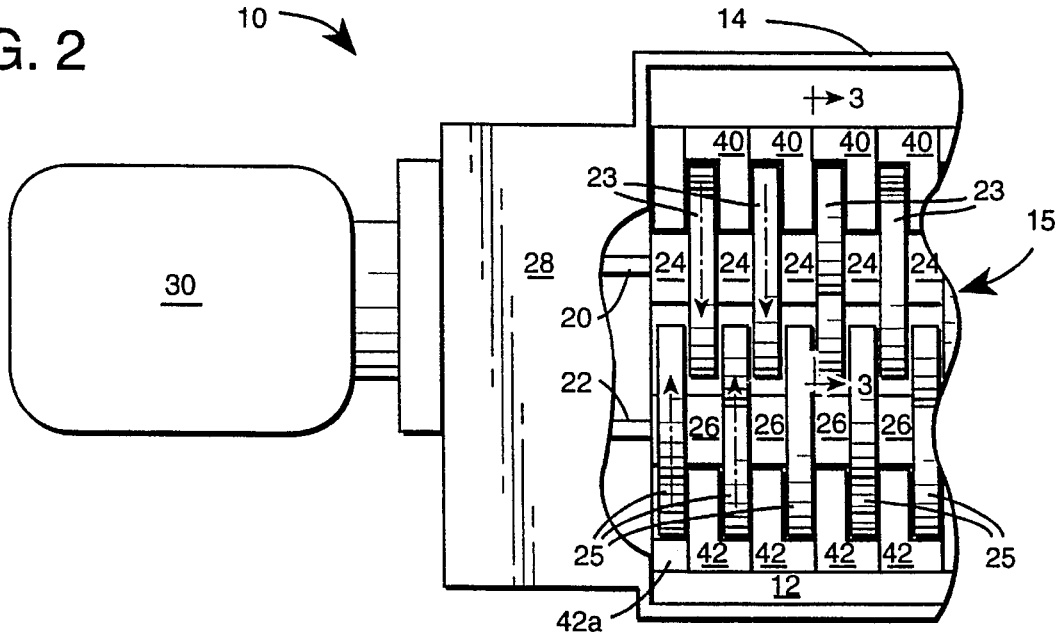
FIG. 2 is a partial top plan view of the industrial shredder shown in FIG. 1.

Accompanying FIGS. 1 and 2 show a particularly preferred embodiment of an industrial shredder 10 according to the present invention. In this regard, the shredder 10 includes a shredder frame body 12 carrying a hopper 14 into which material to be shredded may be deposited. The frame body 12 defines a bounded interior shredding area 15 (see FIG. 2) and is supported above ground surface GS by any suitable rigid platform base 16 so that the shredded material may drop from the shredding area 15 of the frame body 12 and into a collection site 18 (which may, for example, be an open receptacle or an input end of a conveyor belt).

The frame body also supports a pair of shafts 20, 22 which carry a series of alternating cutter discs 23, 25 and spacer discs 24, 26, respectively. The shafts 20, 22 are coupled via gear box 28 to a motor 30 in such a manner that the motor drives the shafts in counter-rotating directions—i.e., so that the upper portions of the cutter discs 23, 25 on the two shafts 20, 22 respectively rotate toward lo each other to force material fed from above into the shredder hopper 14 downwardly between the two shafts 20, 22 where the material is shredded in the nip between the interdigitated cutter and spacer elements 23, 24 and 25, 26. The material is thus shredded in the nip by the action of the counter-rotating cutter discs 23, 25.

The cutter discs 23, 25 may have virtually any profile which is suitable for the particular material being shredded. Various cutter disc profiles are known, for example, from U.S. Pat. Nos. 3,146,960, 3,630,460, 3,664,592 and 3,845,907, the entire content of each being incorporated hereinto by reference. In general, however, the cutter discs will necessarily have at least one profiled tooth which is machined into the cutter disc to obtain the desired tooth depth and angular orientation. By way of example only, the cutter disc 23 shown in accompanying FIG. 3 has been machined so as to include a pair of opposed cutter teeth 23*a*. The individual cutter discs 23, 25 may thus be provided with different profiles (e.g., having different number and/or orientations of cutter teeth) so as to accomplish any desired shredding operation in the most efficient manner. Preferably, the shafts 20, 22 each have a hexagonal cross-section so as to allow various orientations of a given series of cutter discs 23, 25 and spacers 24, 26 and thereby provided for virtually any desired cutter profile without the need for individually dedicated discs 23, 25.

Important to the present invention, the frame body 12 of shredder 10 is provided with opposed series of finger blocks 40, 42 which are mounted to the frame body laterally parallel to the shafts 20, 22, and hence in opposition to the series of cutter/spacer discs 23/24 and 25/26, respectively. One of the finger blocks 40 is depicted in accompanying FIG. 3 and is representative of the other finger blocks 42. Thus, the discussion which follows with regard to finger 15 block 40 is similarly applicable to the finger block 42.

Figure 3:
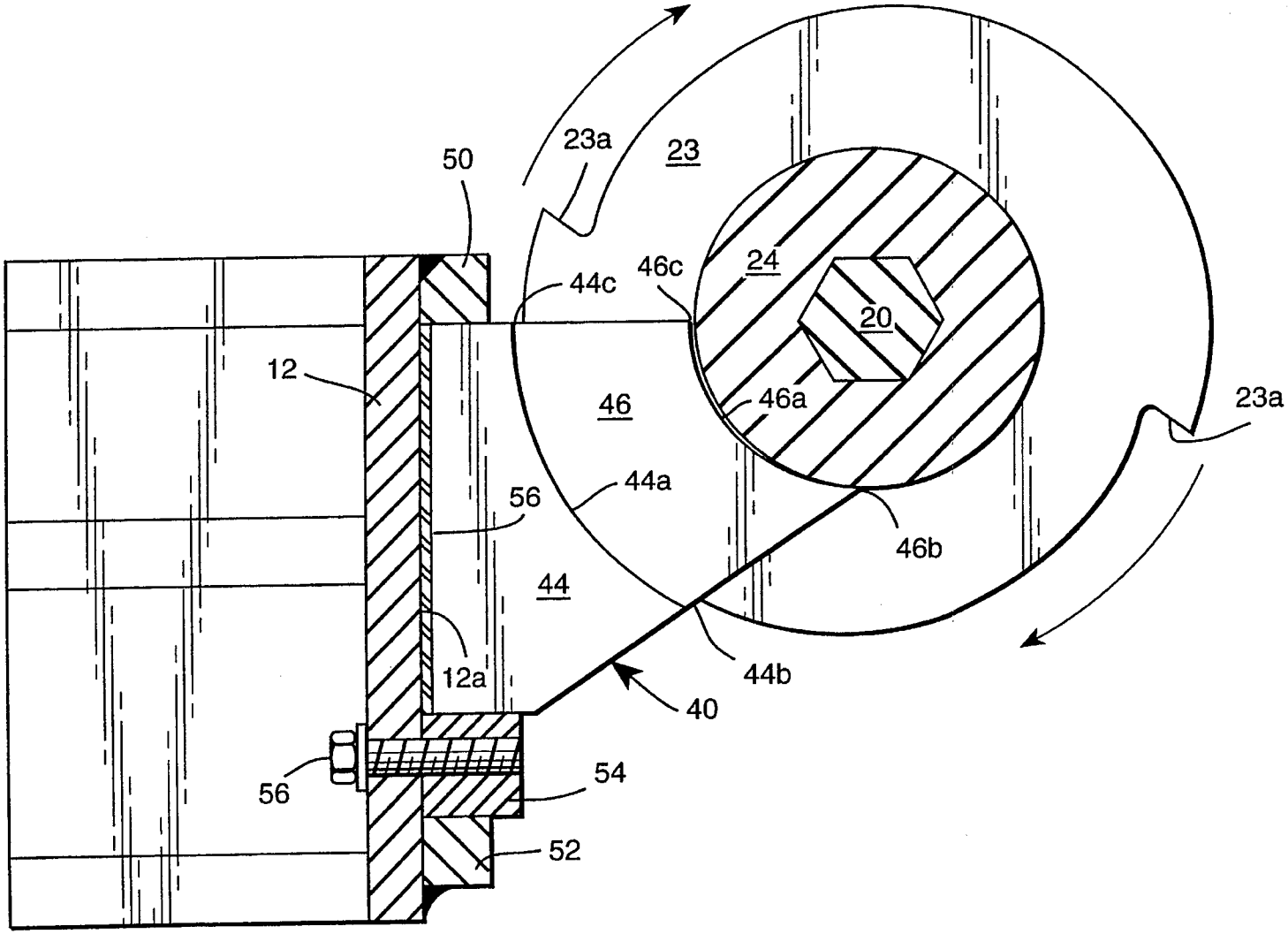
FIG. 3 is an enlarged side elevational view showing an exemplary finger element according to the present invention and its relationship to exemplary cutter and spacer discs of the shredder.

As seen in FIG. 3, the finger block 40 is unitarily provided with respective cutter and spacer fingers 44, 46 which generally radially project inwardly toward the shaft 20. The series of finger blocks 40, 42 may however each include an endmost block 40*a*, 42*a* comprised of only one of the cutter or spacer fingers 44, 46 so as to accommodate the spacer disc 24, 26 or cutter disc 23, 25 in opposition thereto at the ends of shafts 20, 22, respectively (see FIG. 2). The ends of the cutter and spacer fingers 44, 46 respectively terminate in arcuate faces 44*a*, 46*a* which are disposed closely adjacent, but do not initially contact, the exterior surfaces of the cutter and spacer discs 23, 24. When the shredder is under load, however, the arcuate faces 46*a* may come into contact the exterior surfaces of the spacer discs 24 due to deflection of the shafts 20 and/or 22. The materials from which the cutter and spacer fingers 44, 46 as well as the spacer discs 24 are made, however, allow the wear rate to be controlled due to such contact.

Preferably, the terminal end faces 44*a*, 46*a* of the cutter and spacer fingers 44, 46 are define the generatrices of a right cylindrical surface whose center axis is disposed slightly eccentric relative to the axis of shaft 20. In such a manner, therefore, the leading (bottom) edges 44*b*, 46*b* of the terminal end faces 44*a*, 46*a* will define a lesser clearance spaces with their opposed cutter and spacer discs 23, 24 as compared to the clearance spaces defined between such cutter and spacer discs 23, 24 and the upper (trailing) edges 44*c*, 46*c* of the cutter and spacer fingers 44, 46.

The pair of parallel, vertically separated upper and lower positioning bars 50, 52 are rigidly attached to the inside lateral face 12*a* of the frame body 12. A mounting bar 54 is removably coupled to the lateral face 12*a* of the frame body 12 via mounting bolt 56. The finger block 40 is thus mounted between the upper positioning bar 50 and the mounting bar 54 adjacent the interior lateral face of the frame body 12. A shim plate 56 may be provided so as to achieve the desired spacing tolerance of the finger block 40 relative to the centerline of the shaft 20.

While the finger block 40 is positionally captured between the upper positioning bar 50 and the mounting bar 54, it is allowed to move slightly, but meaningfully, in both a vertical direction between the bars 50 and 54 (i.e., within the plane of FIG. 3) and horizontal direction parallel to the axis of shaft 20 (i.e., normal to the plane of FIG. 3). The amount of such vertical and/or horizontal movements is determined by the tolerance dimensions of the bars 50, 52, 54 and/or by the dimensioning of the finger block 40 itself. In this regard, the tolerance dimensions are most preferably selected to allow for movements of the finger block 40 of between about 0.015 to about 0.060 inch in the vertical direction and between about 0.020 to about 0.100 inch in the horizontal direction.

In operation, the tight running clearance of the finger blocks 40, 42 as described above minimizes the occurrence of shredded material being carried upwardly and jamming into the fingers causing so-called "bearding". Severe bearding results in overload conditions in downstream processing equipment since material typically would build to a weight that could no longer be held, and then fall in a mass which could also jam the material conveyance systems.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a shredder having a frame body, and a pair of counter-rotatable shafts mounted to the frame body for counter-rotation about respective rotation axes, each said shaft carrying a series of cutter discs which define a shredding nip therebetween, each of said cutter discs being rotatable in the same rotational direction as said shaft and including at least one cutter tooth for shredding material fed into said shredding nip, the improvement comprising:

finger blocks mounted to said frame body so as to extend inwardly toward said cutter discs and allow for movement relative to said shafts during shredding;

said finger blocks having terminal faces with leading and trailing edges relative to the rotational direction of respective ones of said cutter discs toward which said finger blocks inwardly extend;

said terminal faces defining a right cylindrical surface which is disposed eccentrically relative to respective ones of said shaft axes such that said leading edges thereof establish a lesser clearance space with said at least one cutter tooth of said respective ones of said cutter discs as compared to clearance spaces defined between said at lest one tooth of said respective ones of said cutter discs and said trailing edges thereof.

2. In a shredder as in claim 1, wherein each said shaft carries a series of alternating cutter discs and spacer discs, the improvement wherein said finger blocks are provided with cutter and spacer fingers which extend inwardly toward said cutter and spacer discs, respectively.

3. In a shredder as in claim 2, the improvement wherein said cutter and spacer fingers are unitary with said finger block.

4. In a shredder as in claim 1 or 3, the improvement wherein said frame body includes a pair of rigidly attached upper and lower positioning bars, and a mounting bar removably coupled to said frame body adjacent one of said upper and lower positioning bars, and wherein said finger block is positionally captured between said mounting bar and the other of said upper and lower positioning bars, said finger block being removable from said captured position on removal of said mounting bar.

5. A shredder comprising:

a frame body which bounds an interior shredding area;

a pair of horizontally disposed parallel shafts journally mounted to said frame body for rotation about respective shaft axes and extending across said interior shredding area bounded thereby, each said shaft carrying a series of alternating cutter and spacer discs in such a manner that a cutter disc of one shaft is opposed to a spacer disc of the other shaft so that the cutter discs of both said shafts are interdigitated with one another and define a nip for shredding material fed therethrough when said shafts are rotated;

a motor for rotating said shafts in opposite directions about said respective shaft axes so that upper portions of said cutter discs on each respective shaft rotate in a direction towards one another; and a series of finger blocks mounted to said frame body laterally parallel to said shafts, each said series of said finger blocks having cutter and spacer fingers extending inwardly towards said shaft in opposed relationship to said cutter and spacer discs carried thereby, wherein (a) said series of finger blocks is mounted to said frame body to allow for horizontal and vertical movements relative to said shafts during shredding, (b) said finger blocks have terminal faces with leading and trailing edges relative to the rotational directions of respective ones of said cutter and spacer discs toward which said finger blocks inwardly;

(c) said terminal faces defining a right cylindrical surface which is disposed eccentrically relative to respective ones of said shaft axes such that said leading edges thereof establish lesser clearance spaces with said respective ones of said cutter and spacer discs as compared to clearance spaces defined between said respective ones of said cutter and spacer discs and said trailing edges thereof, and wherein said frame body includes a finger mounting assembly which includes, a pair of rigidly attached upper and lower positioning bars, mounting bars removably coupled to said frame body adjacent one of said upper and lower positioning bars, and wherein each of said finger blocks is positionally captured between a respective one of said mounting bars and the other of said upper and lower positioning bars, said finger blocks being removable from said captured position on removal of said respective one of said mounting bars, and a shim plate disposed between said respective one of said positioning bars and the other of said upper and lower positioning bars, and between said fiber element and said frame body to allow for selective tolerances of said clearance spaces to be achieved.

6. A shredder as in claim 5, wherein said cutter and spacer fingers are unitary with each said finger block.

7. An industrial shredder comprising:

a pair or counter-rotatable shafts which are rotatable about respective shaft axes, each said shaft carrying an alternating plurality of cutter and spacer discs in such a manner that a cutter disc of one shaft is opposed to a spacer disc of the other shaft so that the cutter discs of both said shafts are interdigitated with one another and define a nip for shredding material fed therethrough when said shafts are counter-rotated; and two rows of finger blocks each being positioned laterally adjacent and parallel to a respective one of said shafts, wherein each said finger block includes unitary cutter and spacer fingers extending inwardly towards said respective one of said shafts in respective opposed relationship to said cutter and spacer discs carried thereby, and wherein said finger blocks have terminal faces with leading and trailing edges relative to the rotational directions of respective ones of said cutter and spacer discs toward which said finger blocks inwardly;

said terminal faces defining a right cylindrical surface which is disposed eccentrically relative to respective ones of said shaft axes such that said leading edges thereof establish a lesser clearance space with said respective ones of said cutter and spacer discs as compared to clearance spaces defined between said respective ones of said cutter and spacer discs and said trailing edges thereof.

8. A shredder as in claim 7, wherein said finger blocks are horizontally and vertically moveable relative to said respective one of said shafts during shredding.

* * * * *